United States Patent [19]

Hubbell et al.

[11] 4,360,155

[45] Nov. 23, 1982

[54] POWDER COATING DISTRIBUTOR

[75] Inventors: Mark E. Hubbell, Brownsburg; Alan R. Riebe, Indianapolis, both of Ind.

[73] Assignee: G & R Electro-Powder Coating Corporation, Indianapolis, Ind.

[21] Appl. No.: 291,313

[22] Filed: Aug. 10, 1981

Related U.S. Application Data

[63] Continuation of Ser. No. 106,100, Dec. 21, 1979, abandoned.

[51] Int. Cl.[3] ..... B05B 5/04; B05D 1/06

[52] U.S. Cl. ..... 239/3; 118/626; 239/104; 239/288; 239/700

[58] Field of Search ..... 239/708, 3, 690, 691, 239/693, 700, 104, 288; 118/624, 626

[56] References Cited

U.S. PATENT DOCUMENTS 3,128,045 4/1964 Gauthier ..... 118/626 X 3,843,054 10/1974 Kendall et al. ..... 239/708

*Primary Examiner*—Evan K. Lawrence

*Attorney, Agent, or Firm*—Woodard, Weikart, Emhardt & Naughton

[57] ABSTRACT

In a distributor for coating powders for electrostatic coating apparatus, an insulator shield member is provided on top of the powder distributor disk, preventing accumulation of charged powder thereon which might otherwise result in uneven distribution of powder from the distributor.

11 Claims, 3 Drawing Figures

POWDER COATING DISTRIBUTOR

This application is a continuation of application Ser. No. 106,100, filed Dec. 21, 1979, now abandoned.

BACKGROUND OF THE INVENTION

1. Field of the Invention

This invention relates generally to electrostatic coating apparatus and methods, and more particularly to a disk for an electrostatic coating powder distributor.

2. Description of the Prior Art

The most pertinent prior art patent of which we are aware is represented by a U.S. Pat. No. 3,843,054 issued Oct. 22, 1974 and which discloses an electrostatic powder spraying apparatus. In that apparatus, there is a non-rotating disk at the outlet of a powder conveying conduit. An electrostatic field is established between the edge of the disk and the articles to be coated. As powder is delivered radially outward from the disk, the particles of powder are electrically charged at the disk and move through the electrostatic field toward the articles to be coated, which are usually at ground potential and, being differently charged from the particles, thereby attract the particles.

A difficulty encountered heretofore with such apparatus is irregularity of coating of the articles. We have endeavored to determine the cause of such irregularities and have determined that an accumulation of particles on the upper surface of the disk occurs during operation. Occasionally, clumps or globs of such particles become dislodged from the disk and move through the field to the articles to be coated, resulting in irregular coating where such clumps become deposited. The present invention is addressed to solving this problem.

SUMMARY OF THE INVENTION

Described briefly, according to a typical embodiment of the present invention, which involves both apparatus and a method of using the apparatus an electrostatically charged outlet member of a coating material dispenser is provided with insulating shield means to prevent accumulation of charged coating material on the outlet member, and thus avoid the opportunity for clumps of charged material to accumulate and become dislodged and transmitted to the articles to be coated.

DESCRIPTION OF THE PREFERRED EMBODIMENT

Figure 1:
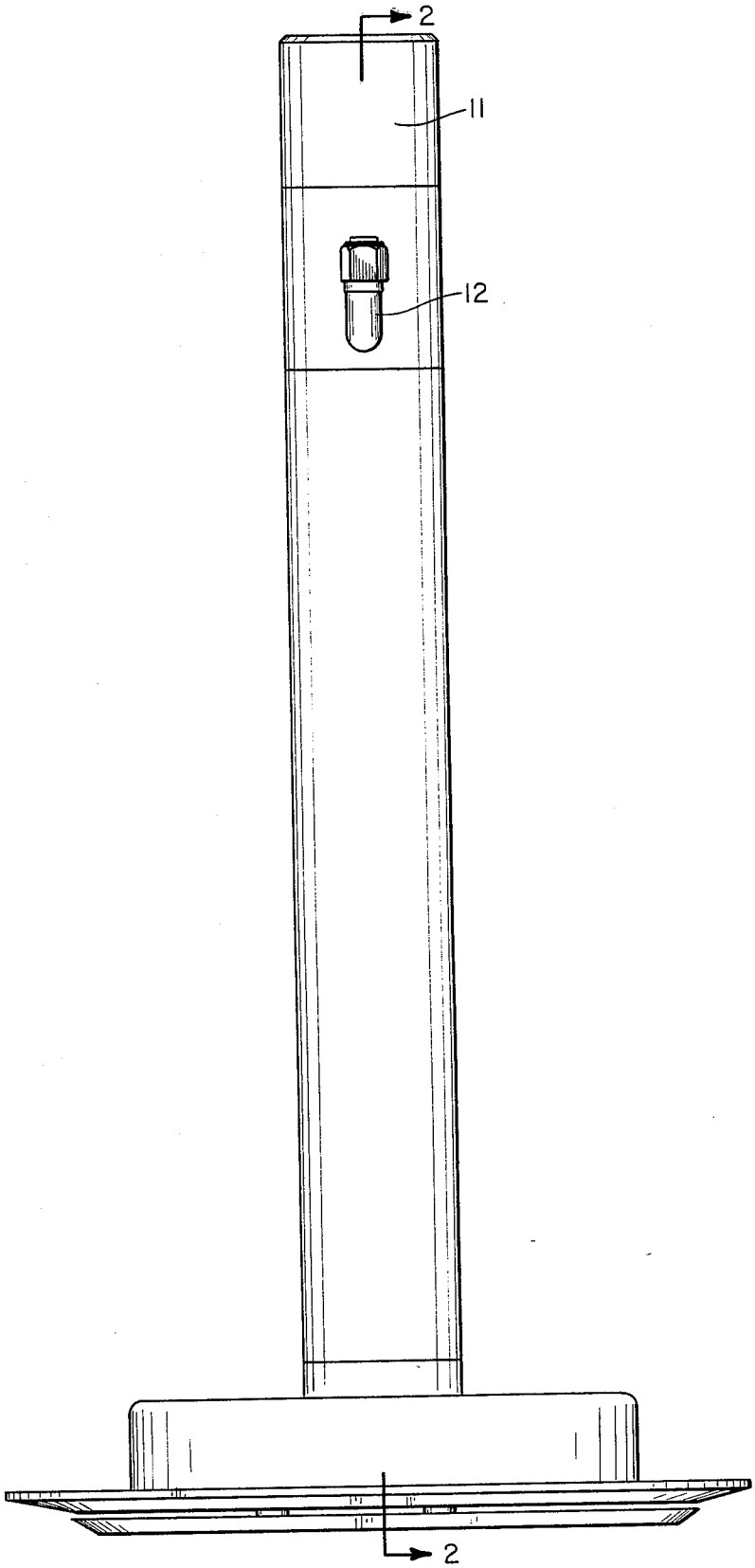
FIG. 1 is an elevational view of a powder coating distributor apparatus incorporating a typical embodiment of the present invention therein.
Figure 2:
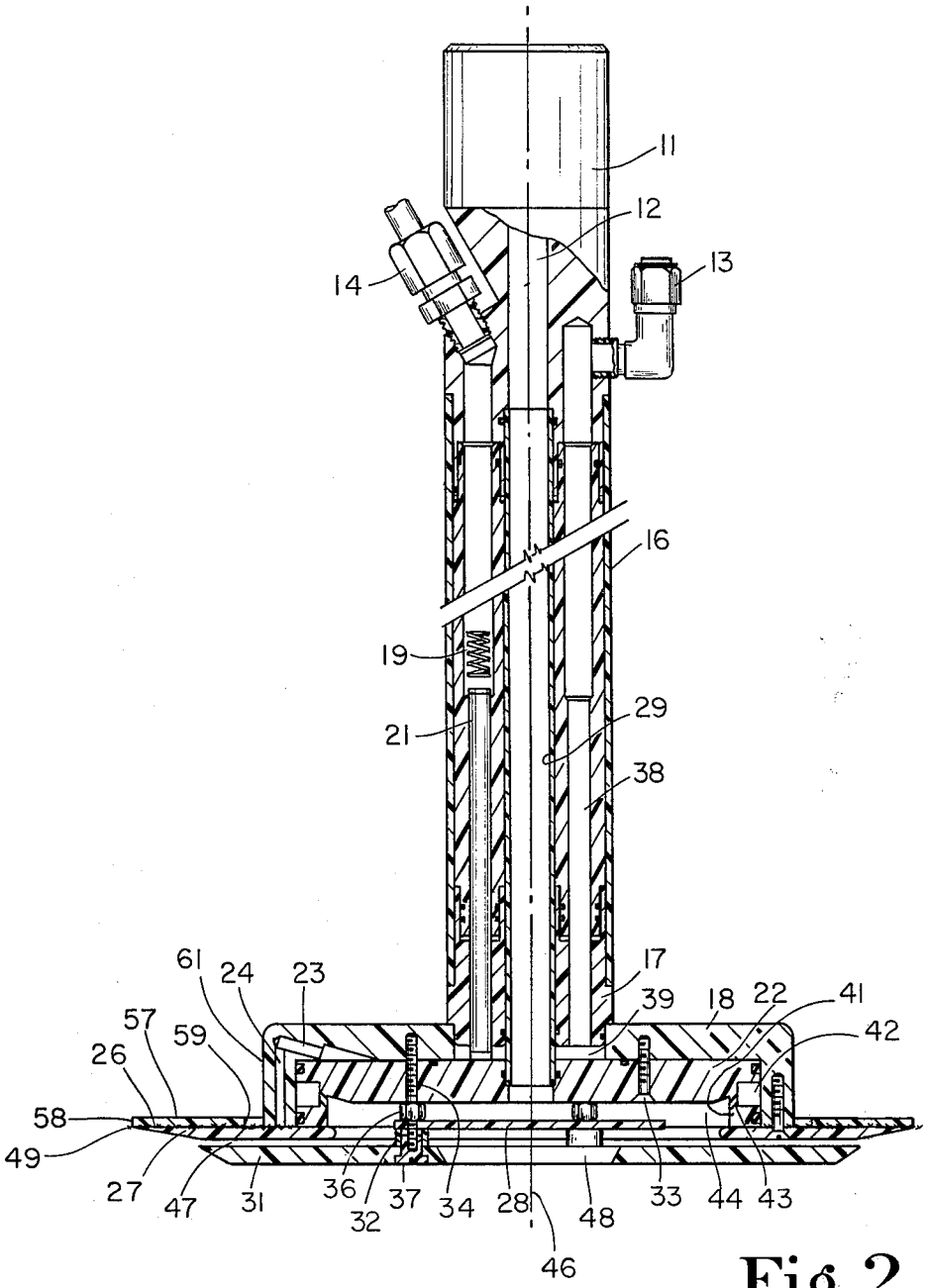
FIG. 2 is a longitudinal section therethrough taken at line 2—2 in FIG. 1 and viewed in the direction of the arrows.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, much of the structure is very similar to that shown in the above mentioned patent, and includes a support head 11 for connection to a reciprocator such as disclosed in the above mentioned patent. A fluidized powder conduit 12 is located on the central axis, a compressed air input fitting 13 is at one side and the electrical cable input fitting 14 is at the other side. A support tube 16 extends down from the head to the lower hub 17 to which housing 18 is mounted.

An electric feed cable lead (not shown) is normally received in the passageway 19 and, through a contact spring (shown loose in the passageway) engages the upper end of a resistor 21 whose lower end may engage a conductive deposit or a further conductor (not shown) received in the diffuser ring 22 and extending through the passageway 23 to electrode 24, the lower end of which is in contact with an electrically conductive coating 26 on top of the distributor disk 27.

Primary baffle 28 is mounted directly under the lower end of the feed tube 29 which extends downward from the feed passageway 12 in the support head 11. A secondary baffle 31 is supported under the distributor disk 27 and spaced therefrom by spacer sleeves such as 32. The diffuser ring 22 is secured to the back plate housing 18 by a combination of circularly spaced flat headed screws 33 and studs 34. There may be three screws and three studs, for example. A hexagonal tool receiving surface 36 is provided on a shoulder portion of the studs and this shoulder portion serves as a spacer between the lower face of the diffuser ring 22 and the upper face of the primary baffle 28. The spacer sleeves 32, of which there may be three, encircling each of the studs at the lower threaded end portion thereof, provides spacing between the secondary baffle and primary baffle, the secondary baffle being secured in place by the cover nuts 37, threadedly received on the lower ends of the studs.

Figure 3:
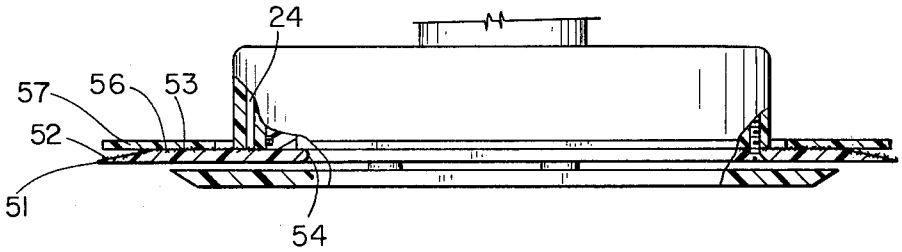
FIG. 3 is a fragmentary sectional view like FIG. 2, but showing a different embodiment of the distributor disk and shield assembly.

Compressed air supplied from a source (not shown) through fitting 13 and passageway 38 is communicable from the space 39 below the hub 17 through passageways (not shown) in the diffuser ring 22 to a plenum chamber 42 from which it can enter through orifices 43 opening into a chamber 44 which receives the fluidized powder from above through the feed tube 29. In this chamber, a swirling effect can be achieved as the fluidized powder is introduced downwardly along the axis 46 of the assembly and the compressed air jets 43, oriented somewhat tangentially to the cylindrical wall 41 of chamber 44, supply air from the perimeter of the chamber 44. The fluidized powder is directed outward by the primary baffle 28 and exits the circular slot 47 between the lower baffle and the distributor disk 27. As this occurs, air may be introduced through the lower central aperture 48 by aspiration from atmosphere as the powder-air mixture departs radially through the slot 47. O-ring seals are employed at a variety of locations in the apparatus for sealing, where desired. Virtually all of these features are incorporated in current production apparatus by Ransburg Electro-Coating Corporation of Indianapolis, Indiana. However, this current production apparatus has the distributor disk as shown in FIG. 3 wherein the circular outer marginal edge 51 of the distributor disk is formed by an upwardly sloping marginal portion 52 on the top of the disk, with an inner portion 53 extending therefrom radially inward to the inner marginal edge 54 of the disk. The electrically conductive material 56 extends from the outer edge 51 inward at least as far as the lower end of the electrode 24. In contrast, according to the preferred embodiment of the present invention, the tapered portion of the distributor disk faces downward, and the conductive material is on the top flat face, but it does extend to the outer marginal edge 49 thereof.

According to another feature of the preferred embodiment of the present invention, an insulator shield ring 57 is mounted atop the conductive face and extends to a circular outer marginal edge 58 spaced just slightly (about 0.062 inches) inboard from the outer edge 49 of the distributor disk 27. Thus it is spaced slightly inward from the remaining narrow ring of conductive material 26 atop the distributor disk 27. The insulator shield ring extends inwardly to an inner marginal edge 59 spaced slightly outward from the cylindrical outer wall 61 of the housing 18.

This insulator ring, like many of the other features of the structure, is made of a material having a high dielectric strength. Phenolics are suitable for this. An example is a G-10 phenolic about 0.125 inches thick. Accordingly, while the potential at the conductive surface 26 on the distributor disk may be 100,000 volts, the resistance of the ring material is so high that the effective potential at the top of the insulator ring may be near ground. In this way, as the powder coating material is dispensed from the distributor in the usual manner, much as described in the above mentioned patent, any material which collects on top of this insulator ring will not maintain a high potential and thus will not be transferred, particularly in globs or clumps, to the articles being coated. Any material which might collect in the small annular space between the insulator ring inner edge 59 and wall 61 will not likely become dislodged, in any event. Yet there is ample annular space between the insulator ring and the housing wall 61 to facilitate getting the ring on and off, when desired.

In the embodiment of FIG. 3, the same basic construction is employed, so far as the insulator ring 57 is concerned. Therefore it is given the same reference numeral. Its effect is the same, except that it overhangs the downwardly sloping upper marginal portion of the distributor disk. Nevertheless, it prevents the vertical descent of coating material on all except a very narrow annular marginal portion of the distributor disk, so small as to not present any accumulation problem.

In both of the illustrated embodiments, the insulator shield ring merely rests on top of the distributor disk. In the event of an application where gravity could not be relied upon to keep the ring properly located on the disk, screws or other fasteners can be employed to secure the shield ring to the distributor disk.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for dispensing a coating material in dry form and including a generally planar distributor disk of electrical insulating material with front and rear surfaces, the front surface having an outer perimetrical edge and at least one aperture spaced inwardly from said edge and communicating with a source of said coating material, and means for directing a flow of said coating material from said aperture outward along said front surface to said edge, and electrically conductive means on the rear surface of said disk extending to said edge and electrically charged to charge said coating material as said coating material from said flow crosses and is dispensed outward from said edge, and including the improvement comprising:

an insulator shield disposed on said rear surface and covering a substantial portion of said electrically conductive means and extending to a location adjacent the said perimetrical edge and leaving exposed a portion of said electrically conductive material adjacent said edge said shield having an electrical insulating characteristic sufficient to inhibit charging of coating material on said shield and said shield inhibiting accumulation of coating material on the said exposed portion of said electrically conductive means.

2. The improvement of claim 1 wherein:

said shield includes a shield plate with a substantially flat front face mounted to said rear surface of said distributor disk and having an outer edge; and said conductive means extends radially outward slightly beyond the outer edge of said shield plate and is exposed to said coating material beyond said outer edge of said shield plate at the said outer perimetrical edge of said distributor disk in the plane of said front face of said shield plate.

3. The improvement of claim 1 wherein:

said distributor disk extends generally horizontally; and said shield includes a shield plate made of an electrically insulating material mounted atop said electrically conductive means on said rear surface of said distributor disk.

4. The apparatus of claim 3 wherein:

said shield plate is rested on the top surface of said distributor disk without attachement to said top surface.

5. The improvement of claim 3 wherein the said electrical insulating characteristic of said shield plate is such that the effective potential at the top of said plate is zero.

6. The improvement of claim 3 wherein said distributor disk is substantially circular about a generally vertical axis, said perimetrical edge being circular, and said shield plate is circular about said axis.

7. The improvement of claim 6 wherein said apparatus has a cover housing of electrically insulating material, a portion of said housing which covers said distributor disk having an outer circular wall at the top of said distributor disk;

said shield plate having a circular inner edge adjacent said wall.

8. The improvement of claim 7 wherein the top of said distributor disk is flat and horizontal from its outer circular edge to said housing wall and:

said shield plate has a bottom surface which snugly engages said flat top around the circumference of said plate at the outer circular edge of said plate to exclude said coating material from said electrically conductive means at the top of said distributor disk, said electrically conductive means extending radially outward slightly beyond the outer circular edge of said shield plate.

9. The improvement of claim 7 wherein the outer marginal portion of the top of said distributor disk slopes upward from the outer circular edge thereof to a horizontal circular top portion radially inward from said outer circular edge and;

said shield plate overhangs and covers substantially all of the said sloping marginal portion and rests on and covers a substantial part of said circular top portion.

10. A method of inhibiting uneven distribution of electrostatic coating material from a powder coating material distributor having a generally planar distributor disk of electrical insulating material with front and rear surfaces, the front surface having an outer perimetrical edge and at least one aperture spaced inwardly from said edge and communicating with a source of said coating material, and means for directing a flow of said coating material from said aperture outward along said front surface to said edge and electrically conductive means on the rear surface of said disk extending to said edge and electrically charged to charge said coating material as said coating material from said flow crosses and is dispensed outward from said edge, said method comprising the step of:

covering with insulator shield means a substantial portion of said electrically conductive means, leaving exposed a portion of said electrically conductive means adjacent said edge, said shield means being provided with an electrical insulating characteristic sufficient to inhibit charging of coating material on said shield means, said shield means inhibiting accumulation of coating material on said exposed portion of said electrically conductive means.

11. The method of claim 10 wherein the covering step comprises:

resting a shield disk on the distributor, without attaching it to the distributor.

* * * * *